US006570326B2

(12) United States Patent
Bannai et al.

(10) Patent No.: US 6,570,326 B2
(45) Date of Patent: May 27, 2003

(54) GRADATION FLUORESCENT DISPLAY DEVICE

(75) Inventors: Masanori Bannai, Mobara (JP); Koji Mitoshi, Mobara (JP); Kazuhiko Tojo, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/900,048

(22) Filed: Jul. 9, 2001

(65) Prior Publication Data

US 2002/0008468 A1 Jan. 24, 2002

(30) Foreign Application Priority Data

Jul. 21, 2000 (JP) ..... 2000-219964

(51) Int. Cl.[7] ..... H05B 33/14
(52) U.S. Cl. ..... 313/506; 345/47
(58) Field of Search ..... 313/485, 486, 313/496, 495, 497, 514, 517, 478; 345/47, 74, 75

(56) References Cited

U.S. PATENT DOCUMENTS 4,395,654 A * 7/1983 Hattori et al. ..... 313/496

* cited by examiner

*Primary Examiner*—Sandra O'Shea
*Assistant Examiner*—Sumati Krishnan
(74) *Attorney, Agent, or Firm*—Oblon, Spivak, McClelland, Maier & Neustadt, P.C.

(57) ABSTRACT

A fluorescent display device capable of attaining gradation display while minimizing the number of types of phosphors. A glass substrate is formed thereon with anode electrodes, each of which has a phosphor film deposited thereon. The phosphor films include a phosphor film exhibiting a first kind of luminous hue, that exhibiting a second kind of luminous hue, and those exhibiting a mixed hue of both luminous hues. The mixed hue is varied by varying an area ratio between both luminous hues.

6 Claims, 9 Drawing Sheets

671 672 673 674 675

681 682 683 684 685

GRADATION FLUORESCENT DISPLAY DEVICE

BACKGROUND OF THE INVENTION

This invention relates to a gradation fluorescent display device, and more particularly to a fluorescent display device adapted to carry out gradation display.

Now, a conventional color fluorescent display device of the gradation display type will be described with reference to FIGS. 10(*a*) and 10(*b*), which are a sectional view of the fluorescent display device and a plan view partly in section taken along line X—X of FIG. 10(*a*), respectively.

In FIGS. 10(*a*) and 10(*b*), reference numeral 91 designates a glass substrate, 92 is a front glass member, 93 to 96 each are a side glass member, 97*l* to 97*n* each are an anode electrode, 98*l* to 98*n* each are a phosphor film deposited on each of the anode electrodes, 99 designates grids, and 100 designates filamentary cathodes.

The anode electrodes 97*l* to 97*n* and phosphor films 98*l* to 98*n* cooperate with each other to constitute n (n: positive integer) display segments, which are arranged in a pattern shown in FIG. 10(*b*).

The phosphor films 98*l* to 98*n* each have a luminous hue stepwise varied for every phosphor film, resulting in carrying out gradation display. The phosphor films each are made of two or more phosphors mixed together. The phosphors are mixed in a different mixing ratio for every phosphor film, so that the phosphor films may be stepwise varied in luminous hue. This is disclosed in, for example, Japanese Patent Application Laid-Open Publication No. 165557/1980.

In the conventional fluorescent display device of the gradation display type, as described above, it is required to vary a mixing ratio of phosphors for every display segment or every phosphor film of the display segment. Thus, when n such display segments are arranged, it is required to prepare phosphors of n types different in mixing ratio, to thereby prepare phosphor pastes of n types. For example, when 10 such display segments are arranged, phosphor pastes of 10 types are required.

Also, in order to permit the conventional fluorescent display device of the gradation display type to carry out desired gradation display, phosphors for the phosphor film of each of the display segments must be accurately mixed at a predetermined mixing ratio. A luminous hue of the phosphor film is delicately varied depending on mixing of the phosphors, resulting in control of the mixing ratio and operation of mixing the phosphors being highly troublesome.

N types of phosphor pastes are used for formation of the phosphor films, so that operation of coating or applying the phosphor pastes must be repeated n times. An increase in number of times of application of the phosphor pastes causes a phosphor paste applied at earlier stages to be pressed or rubbed by masks for application used at later stages or polluted by phosphor pastes applied at later stages, to thereby often cause a deterioration in luminous efficiency of the phosphor films or color shading in luminous hue. Also, it may possibly lead to peeling-off of the phosphor pastes applied at earlier states. Further, in order to execute application of the phosphor pastes at later states in the application step, drying of the phosphor pastes applied at earlier stages is required. Thus, an increase in number of types of phosphor pastes causes a long period of time to be required in the application step, leading to a deterioration in manufacturing efficiency.

Further, in the prior art, the phosphor films each are formed of phosphors of two or more types different in life, so that a luminous hue of the phosphor film is often varied with time due to a difference in life between the phosphors.

Moreover, the conventional fluorescent display device of the gradation display type requires to develop phosphors of new hues in conformity to gradations desired. Unfortunately, such development is time-consuming and costly, resulting in failing to satisfactorily meet requirements on gradations demanded by consumers.

SUMMARY OF THE INVENTION

The present invention has been made in view of the foregoing disadvantages of the prior art.

Accordingly, it is an object of the present invention to provide a fluorescent display device which is capable of carrying out gradation display without mixing phosphors with each other.

In accordance with the present invention, a fluorescent display device is provided. The fluorescent display device includes a plurality of display segments each including an anode electrode and a phosphor film deposited on the anode electrode. The phosphor film is constituted by phosphor film elements different in luminous hue which are arranged in juxtaposition to each other. The phosphor film elements different in luminous hue of each of the phosphor films have an area ratio therebetween varied depending on the display segment.

Also, in accordance with the present invention, a fluorescent display device is provided. The fluorescent display device includes a plurality of display segments each including an anode electrode and a phosphor film deposited on the anode electrode. The phosphor film is constituted by phosphor film elements different in luminous chroma or luminous lightness which are arranged in juxtaposition to each other. The phosphor film elements different in luminous chroma or luminous lightness of each of the phosphor films have an area ratio therebetween varied depending on the display segment.

Further, in accordance with the present invention, a fluorescent display device is provided. The fluorescent display device includes a plurality of display segments each including an anode electrode and a phosphor film deposited on the anode electrode. The phosphor film of each of the display segments has an area varied in order depending on the display segment.

In a preferred embodiment of the present invention, the phosphor film of a part of the display segments is constituted by one kind of phosphor film element.

In a preferred embodiment of the present invention, the display segments constitute a display segment group. The area ratio between the phosphor film elements is varied depending on the display segment group.

In a preferred embodiment of the present invention, an area of each of said display segments is varied depending on the display segment.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIGS. 1(*b*) and 1(*c*) each are a sectional view taken along line U—U of FIG. 1(*a*);

FIG. 4(*b*) is a sectional view taken along line Z—Z of FIG. 4(*a*);

FIG. 5(*b*) is a sectional view taken along line V—V of FIG. 4(*a*);

FIGS. 9(*b*) to 9(*d*) each are a sectional view taken along line W—W in FIG. 9(*a*);

FIG. 10(*b*) is a plan view taken along line X—X of FIG. 10(*a*).

DETAILED DESCRIPTION OF THE PREFERRED EMBODIMENTS

Now, a gradation fluorescent display device according to the present invention will be described with reference to FIGS. 1(*a*) to 9(*d*).

Figure 1A:
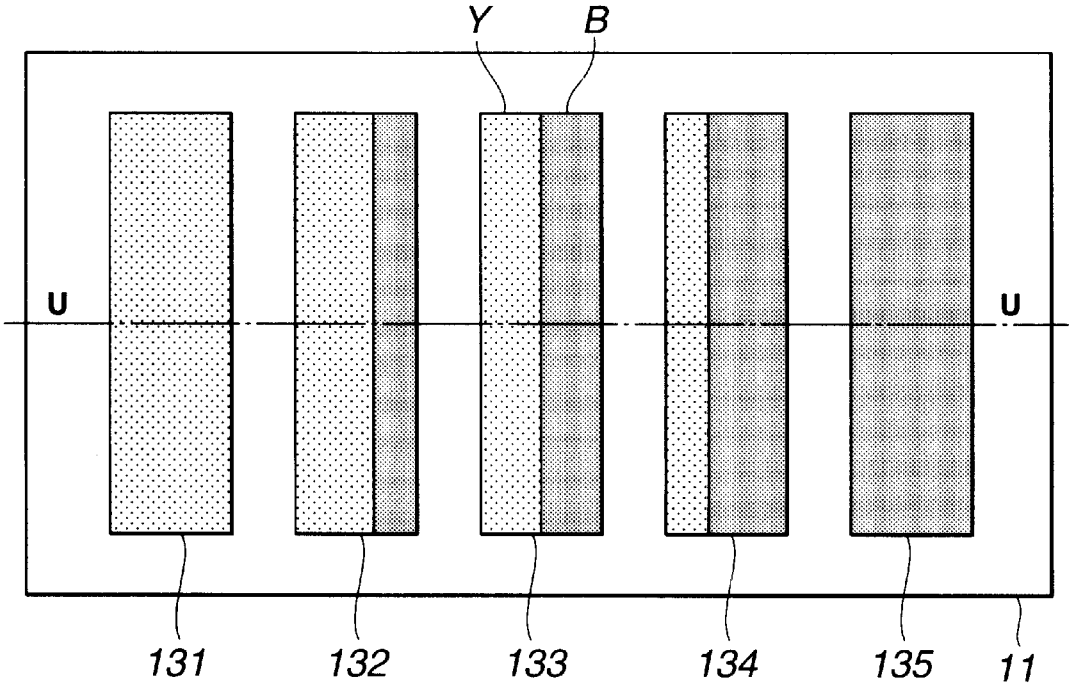
FIG. 1(*a*) is a plan view showing a glass substrate incorporated in a first embodiment of a gradation fluorescent display device according to the present invention.
Figure 1B:
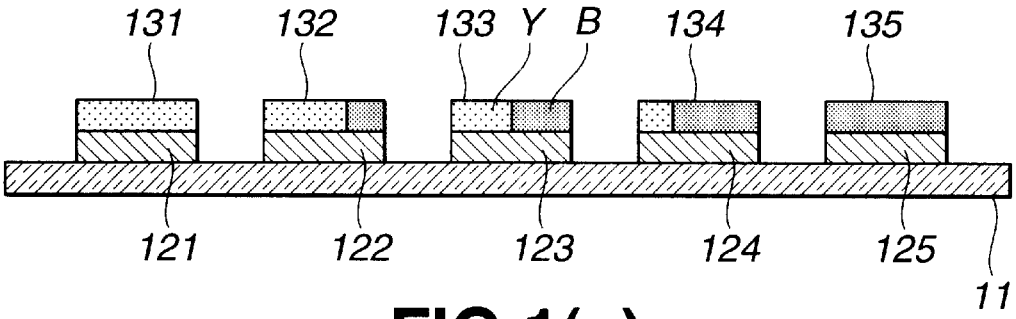
Figure 1C:
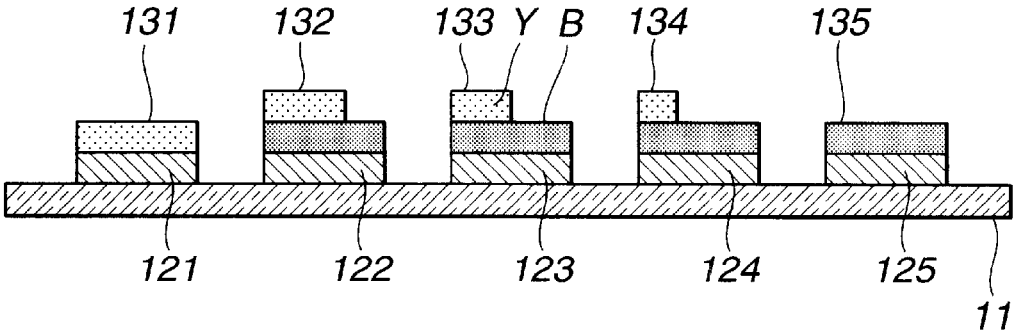

Referring first to FIGS. 1(*a*) to 1(*c*), a first embodiment of a gradation fluorescent display device according to the present invention is illustrated.

A gradation fluorescent display device of the illustrated embodiment includes a glass substrate 11, on which anode electrodes 121 to 125 are arranged. The anode electrodes 121 to 125 have phosphor films 131 to 135 deposited thereon, respectively. In the illustrated embodiment, the anode electrodes 121 to 125 and phosphor films 131 to 135 cooperate with each other to constitute five display segments. Five such display segments are arranged in a pattern shown in FIG. 1(*a*).

First, FIGS. 1(*a*) and 1(*b*) will be described.

The phosphor films 131 to 135 each are constituted by two kinds of phosphor film elements or a phosphor film element of a luminous hue Y (for example, yellow) and that of a luminous hue B (for example, blue). The phosphor film 131 is constituted by only the phosphor film element of the luminous hue Y and the phosphor film 135 is constituted by only the phosphor film element of the luminous hue B. The phosphor films 132, 133 and 134 each are constituted by the phosphor film element of the luminous hue Y and that of the luminous hue B which are arranged in juxtaposition with each other.

More particularly, the phosphor film 132 is so constructed that a ratio in area (area ratio) between the phosphor film element of the luminous hue Y and that of the luminous hue B is ⅔. The phosphor films 133 and 134 have an area ratio set to be ½ and ⅓, respectively. Thus, the area ratio is gradually reduced from the phosphor film 132 to the phosphor film 134 in order.

Such arrangement of the phosphor films 131 to 135 permits luminous colors thereof to be recognized to be, for example, yellow, yellowish green, green, bluish green and blue by the human eyes, respectively, resulting in hue gradation being formed. This is due to the fact that a plurality of colors juxtaposed to each other are recognized as a mixed color thereof by the human eyes. Even when the phosphor films are arranged as described above in a manner to form a gap therebetween, the luminous colors are recognized as the mixed color as a whole so long as the gap is as small as about 0.15 to 0.2 mm.

Thus, it will be noted that the present invention is so constructed that five kinds of hues are generated by two kinds of hues obtained due to luminescence of the phosphor film elements of the luminous hues Y and B, leading to gradation display. For comparison, in manufacturing of the conventional fluorescent display device of the gradation display type including five such display segments, it is required to mix the phosphors at five mixing ratios. On the contrary, the present invention merely requires two kinds of phosphors.

In the illustrated embodiment, five such display segments are arranged. Alternatively, the number of display segments may be further increased to further subdivide the area ratio between the phosphor film element of the luminous hue Y and that of the luminous hue B, resulting in more smoothing a variation in hue. In this instance, even when the number of display segments is increased to a level as large as, for example, ten (10), only two phosphor elements of the luminous hues Y and B are merely required in the present invention.

The phosphor films 131 to 135 may be formed by any suitable printing techniques widely known in the art. For example, any one of a phosphor paste of a luminous hue Y and that of a luminous hue B is printed and then the other is printed.

Now, FIG. 1(*c*) will be described, which has substantially the same pattern as FIG. 1(*b*) described above, except that a manner of arrangement of phosphor film elements of luminous hues Y and B is different from that shown in FIG. 1(*b*). In FIG. 1(*c*), anode electrodes 122, 123 and 124 each have a phosphor film element of a luminous hue B formed thereof, which is then formed thereon with a phosphor film element of a luminous hue Y. A ratio in area (area ratio) between portions of both phosphor film elements exposed on each of the anode electrodes 122 to 124 is the same as that in FIG. 1(*b*).

Arrangement shown in FIG. 1(*c*) prevents formation of a gap between the phosphor film elements of the luminous hues Y and B on each of the anode electrodes 122 to 124 because both phosphor film elements are not arranged in a manner to be butted against each other. Arrangement shown in FIG. 1(*c*) causes both phosphor film elements to overlap each other. However, the fluorescent display device utilizes low-velocity electron beams, to thereby prevent electrons emitted from filaments or cathodes from reaching the lower phosphor film element of the luminous hue B through the upper phosphor film element of the luminous hue Y. This prevents color mixing at the overlapping between both phosphor film elements.

The phosphor films 131 to 135 may be formed using any printing techniques widely known in the art. For example, a phosphor paste of a luminous hue B is printed and then that of a luminous hue Y is printed on the former phosphor paste.

Figure 2:
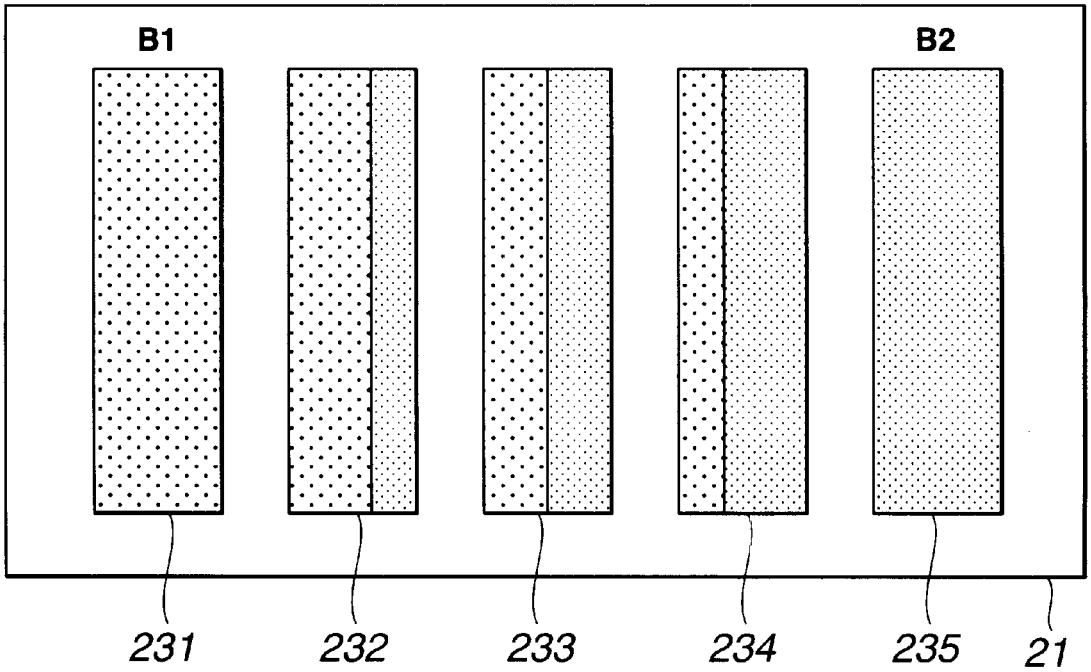
FIG. 2 is a plan view showing a glass substrate incorporated in a second embodiment of a gradation fluorescent display device according to the present invention.

Referring now to FIG. 2, a glass substrate incorporated in a second embodiment of a fluorescent display device according to the present invention is illustrated. In a fluorescent display device of the illustrated embodiment, five display segments are arranged so as to carry out gradation display or display of which luminous chroma or luminous lightness is gradated.

In FIG. 2, reference numeral 21 designates a glass substrate, and 231 to 235 each are a phosphor film formed on each of anode electrodes. The phosphor film 231 is constituted by only a phosphor film element of luminous chroma or luminous lightness B1 and the phosphor film 235 is constituted by only a phosphor film element of luminous chroma or luminous lightness B2. The phosphor films 232, 233 and 234 each are constituted by both phosphor film elements arranged in juxtaposition to each other. Arrangement of both phosphor film elements in juxtaposition to each other is so carried out that a ratio in area (area ratio) of the phosphor film element of the luminous chroma or lightness B1 to that of the luminous chroma or lightness B2 is, for example, ⅔ in the phosphor film 232, ½ in the phosphor film 233 and ⅓ in the phosphor film 234. Thus, the area ratio is gradually reduced from the phosphor film 232 to the phosphor film 234.

Thus, it will be noted that the illustrated embodiment permits five kinds of chroma or lightness generated by two kinds of luminous chroma or luminous lightness obtained due to luminescence of the phosphor film elements of the luminous chroma or lightness B1 and luminous chroma or lightness B2 to lead to gradation display.

Figure 3:
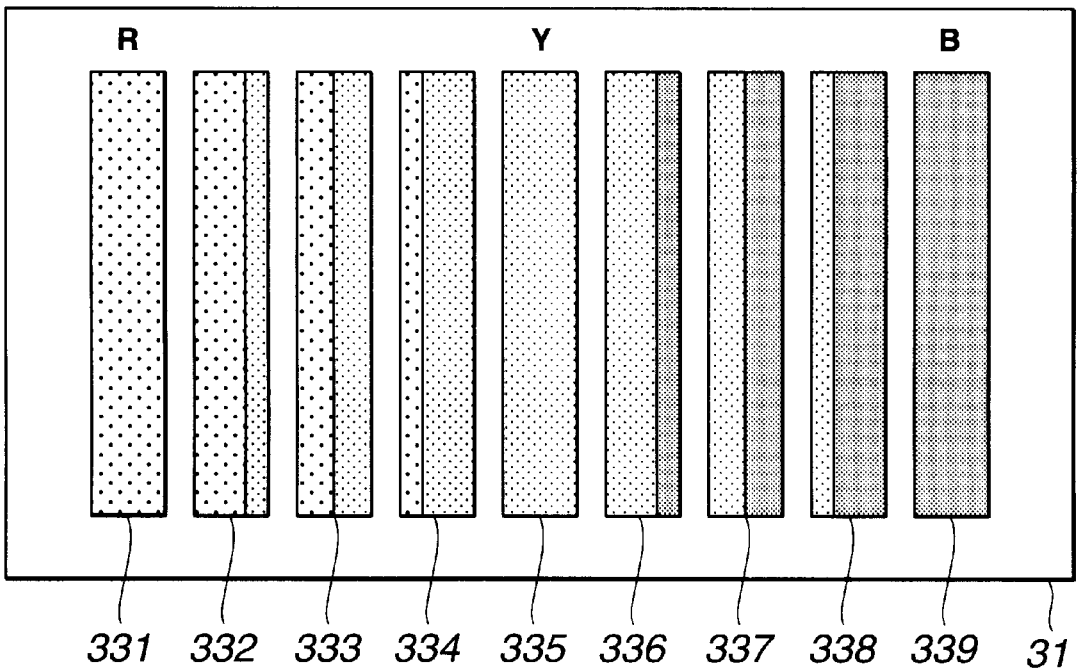
FIG. 3 is a plan view showing a glass substrate incorporated in a third embodiment of a gradation fluorescent display device according to the present invention.

Referring now to FIG. 3, a glass substrate incorporated in a third embodiment of a gradation fluorescent display device according to the present invention is illustrated. In a fluorescent display device of the illustrated embodiment, three kinds of phosphor film elements different in luminous hue from each other are arranged so as to carry out hue gradation display or display of which a hue is gradated. In FIG. 3, reference numeral 31 designates a glass substrate and 331 to 339 each are a phosphor film formed on each of anode electrodes.

Arrangement shown in FIG. 3 is constructed in substantially the same manner as that shown in FIG. 1(*b*), except that phosphor film elements of three kinds of luminous hues R, Y and B are arranged. The phosphor films 331, 335 and 339 each are constituted by only one kind of phosphor film element. More particularly, the phosphor film 331 is constituted by only a phosphor film element of a luminous hue R, the phosphor film 335 is constituted by only a phosphor film element of a luminous hue Y and the phosphor film 339 is constituted by only a phosphor film element of a luminous hue B. The phosphor films 332, 333 and 334 each are constituted by two kinds of phosphor film elements or the phosphor film element having the luminous hue Y and that of the luminous hue B.

As described above, the embodiment of FIG. 3 includes three kinds of phosphor film elements different in luminous hue. Alternatively, four or more phosphor film elements different in luminous hue may be incorporated.

Figure 4A:
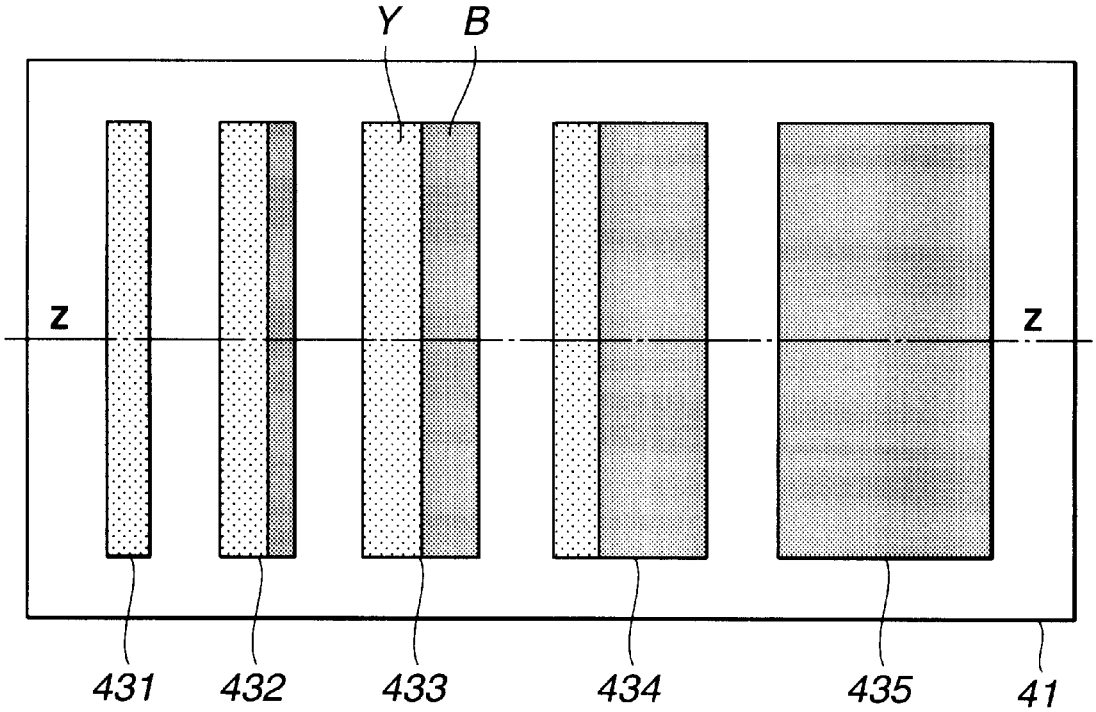
FIG. 4(*a*) is a plan view showing a glass substrate incorporated in a fourth embodiment of a gradation fluorescent display device according to the present invention.
Figure 4B:
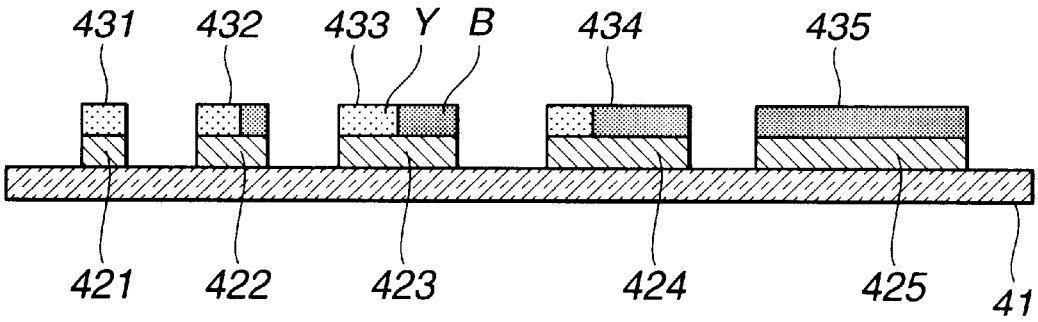

Referring now to FIGS. 4(*a*) and 4(*b*), a glass substrate incorporated in a fourth embodiment of a fluorescent display device according to the present invention is illustrated, wherein FIG. 4(*a*) is a plan view of the fluorescent display device and FIG. 4(*b*) is a sectional view taken along line Z—Z of FIG. 4(*a*).

In the fluorescent display device shown in FIGS. 4(*a*) and 4(*b*), two kinds of phosphor film elements different in luminous hue are incorporated in order to carry out hue gradation display as in the embodiment shown in FIGS. 1(*a*) to 1(*c*). FIGS. 4(*a*) and 4(*b*) are different in configuration of anode electrodes from FIGS. 1(*a*) and 1(*b*).

In FIGS. 4(*a*) and 4(*b*), reference numeral 41 designates a glass substrate, 421 to 425 each are an anode electrode, and 431 to 435 each are a phosphor film deposited on each of the anode electrodes 421 to 425.

The anode electrodes 421 to 425 and phosphor films 431 to 435 cooperate with each other to constitute five display segments, which are arranged in a pattern shown in FIG. 4(*a*).

The anode electrodes 421 to 425 and phosphor films 431 to 435 are so formed that widths thereof are stepwise varied in order. This results in the display segments being stepwise varied in luminous area. The phosphor films 431 to 435 each are constituted by at least one of two kinds of phosphor film elements or at least one of a phosphor film element of a luminous hue Y and that of a luminous hue B. More specifically, the phosphor film 431 is constituted by only the phosphor film element of the luminous hue Y and the phosphor film 435 is constituted by only the phosphor film element of the luminous hue B. The phosphor films 432 to 434 each are constituted by a combination of the phosphor film element of the luminous hue Y and that of the luminous hue B which are arranged in juxtaposition to each other. The phosphor films 432, 433 and 434 are so formed that a ratio in area (area ratio) of the phosphor film element of the luminous hue Y to that of the luminous hue B is, for example, ⅔ in the phosphor film 432, ½ in the phosphor film 433 and ⅓ in the phosphor film 434. Thus, the area ratio is gradually reduced from the phosphor film 432 to the phosphor film 434.

Thus, it will be noted that the illustrated embodiment is constructed so as to stepwise vary a width of the display segments, leading to formation of hue gradation and a variation in luminous area of the display segments, resulting in a gradation effect being more enhanced.

In the illustrated embodiment, as described above, both anode electrodes and phosphor layers are varied in width to vary a width of the display segments. Alternatively, a solid anode electrode may be arranged as shown in FIG. 9(*d*) which will be described below. In such a modification, only a width of phosphor films may be varied.

Figure 5A:
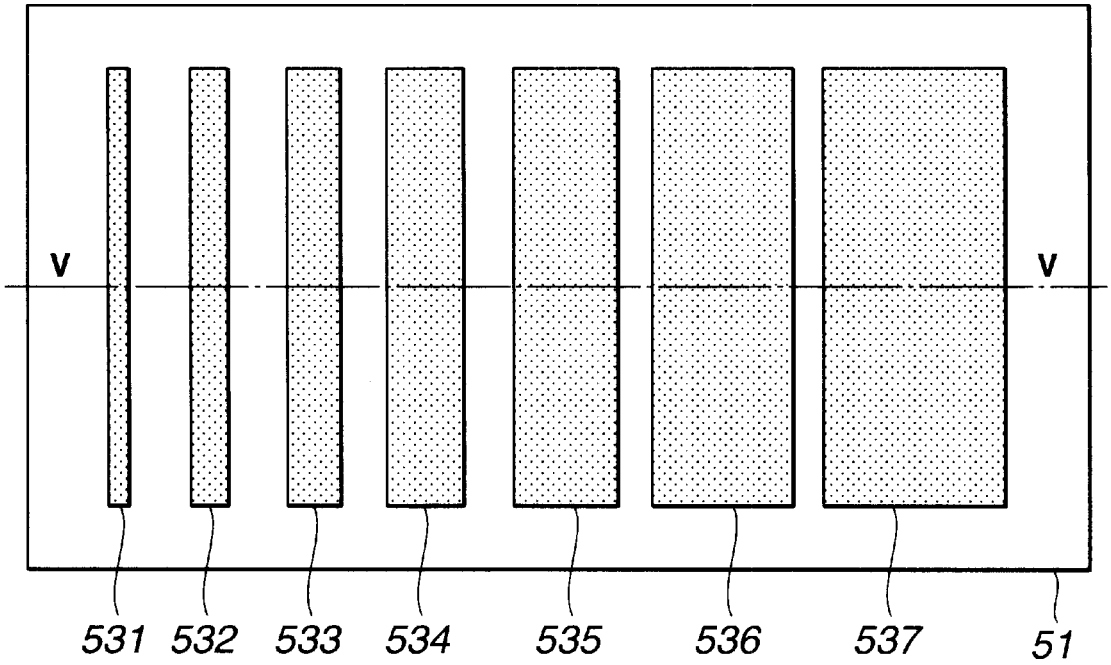
FIG. 5(*a*) is a plan view showing a glass substrate incorporated in a fifth embodiment of a gradation fluorescent display device according to the present invention.
Figure 5B:
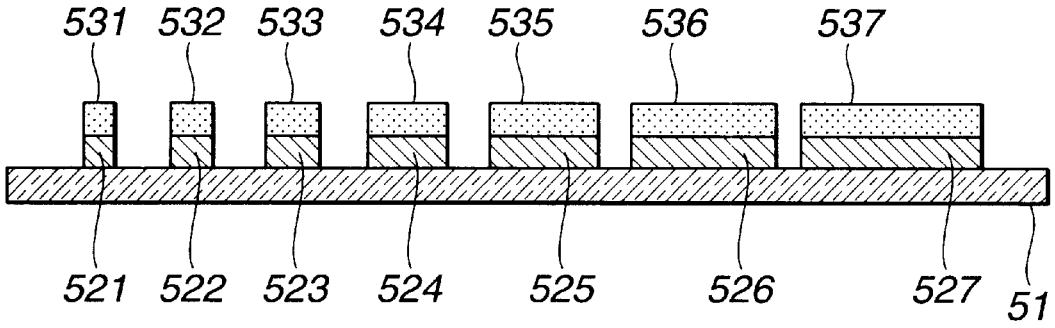

Referring now to FIGS. 5(*a*) and 5(*b*), a glass substrate incorporated in a fifth embodiment of a fluorescent display device according to the present invention is illustrated, wherein FIG. 5(*a*) is a plan view of the fluorescent display device and FIG. 5(*b*) is a sectional view taken along line V—V of FIG. 5(*a*).

In FIGS. 5(*a*) and 5(*b*), reference numeral 51 designates a glass substrate, 521 to 527 each are an anode electrode, and 531 to 535 each are a phosphor film deposited on each of the anode electrodes 521 to 525.

The anode electrodes 521 to 527 and phosphor films 531 to 537 cooperate with each other to constitute seven display segments, which are arranged in a pattern shown in FIG. 5(*a*).

The anode electrodes 521 to 527 and phosphor films 531 to 537 are so formed that a width thereof is stepwise increased in order. Also, the anode electrodes 521 to 527 are so arranged that intervals therebetween are stepwise reduced in order. The phosphor films 531 to 537 each are constituted by a phosphor film element of only one luminous hue such as, for example, green (G).

Thus, in the embodiment shown in FIGS. 5(*a*) and 5(*b*), the luminous hue of each of the display segments is green. However, the display segments are formed to be different in width thereof and interval therebetween from each other. Thus, the phosphor film 531 exhibits a light-green feeling, the phosphor films 532 to 536 exhibit greens stepwise rendered dark in order, respectively, and the phosphor film 537 exhibits the deepest green feeling.

Figure 6A:
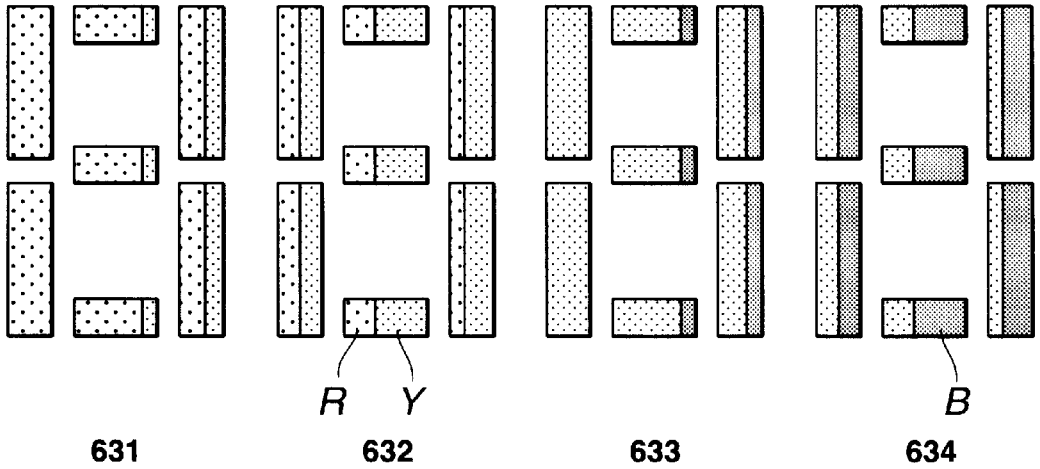
FIGS. 6(*a*) and 6(*b*) each are a plan view showing a display segment pattern in a sixth embodiment of a gradation fluorescent display device according to the present invention.
Figure 6B:
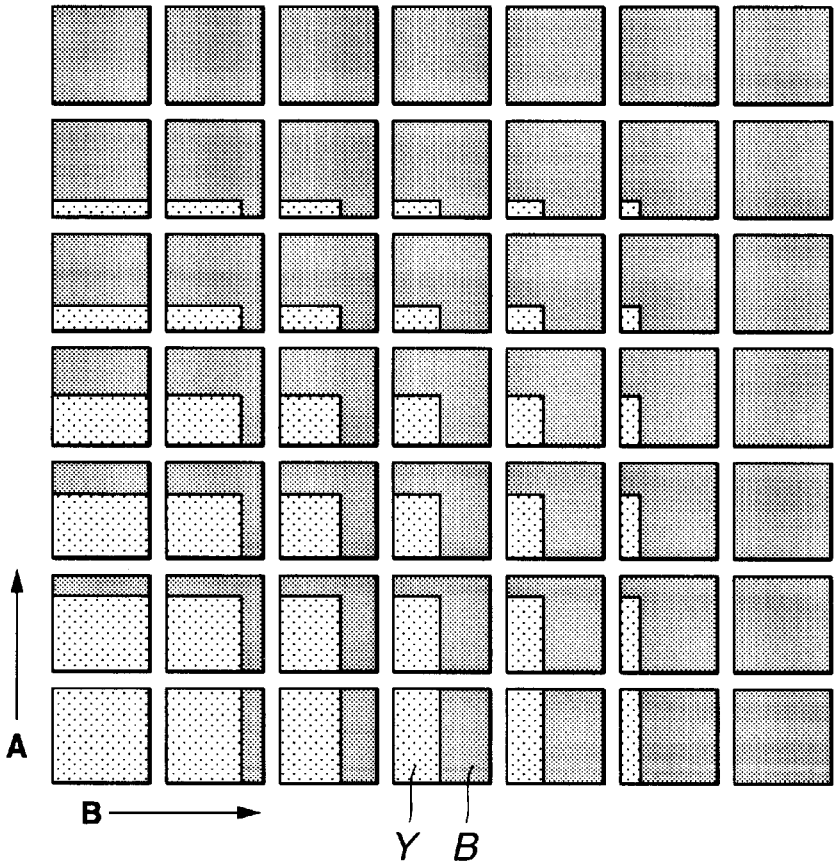

Referring now to FIG. 6(*a*), a sixth embodiment of a fluorescent display device according to the present invention is illustrated. A fluorescent display device of the illustrated embodiment is different in pattern of arrangement of display segments from the above-described embodiments.

Figure 8A:
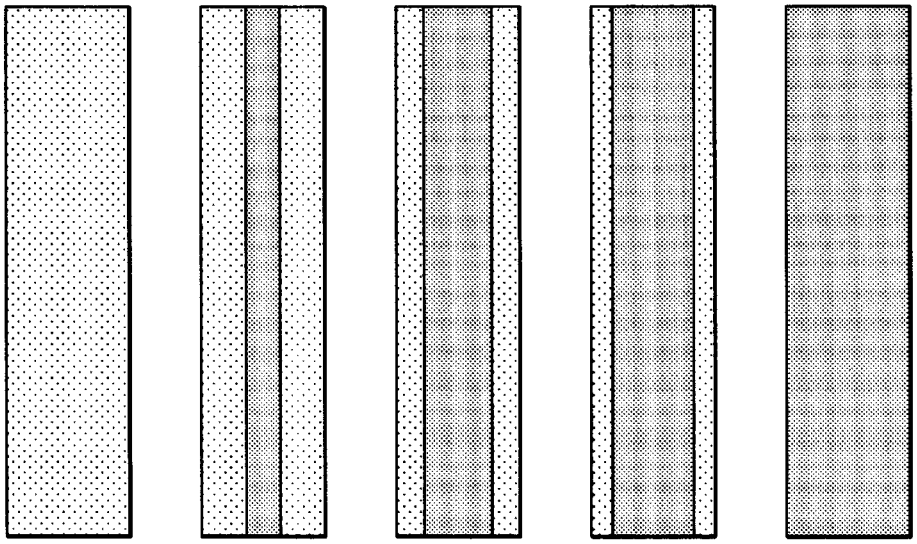
FIGS. 8(*a*) and 8(*b*) each are a plan view showing a pattern of arrangement of phosphor films in an eighth embodiment of a gradation fluorescent display device according to the present invention.
Figure 8B:
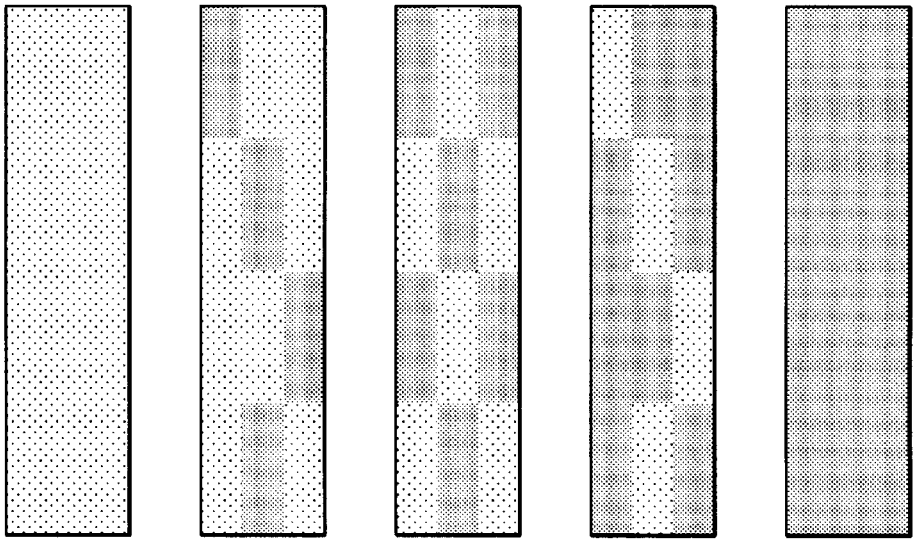
Figure 9A:
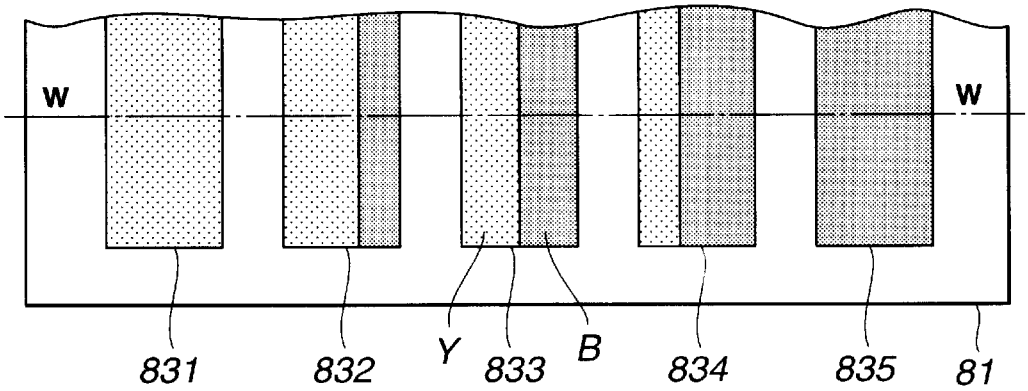
FIG. 9(*a*) is a fragmentary plan view showing a glass substrate incorporated in a ninth embodiment of a gradation fluorescent display device according to the present invention.
Figure 9B:
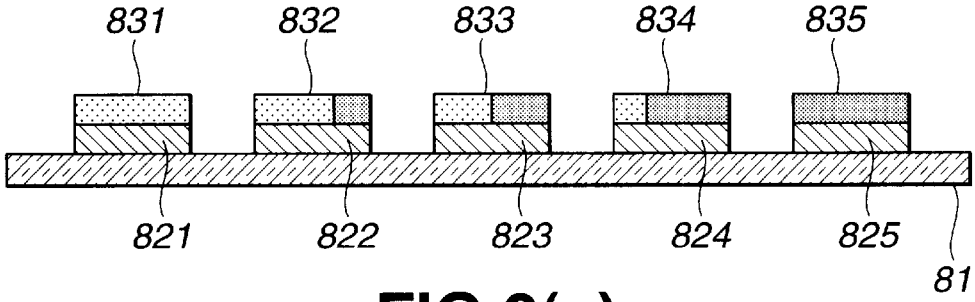
Figure 9C:
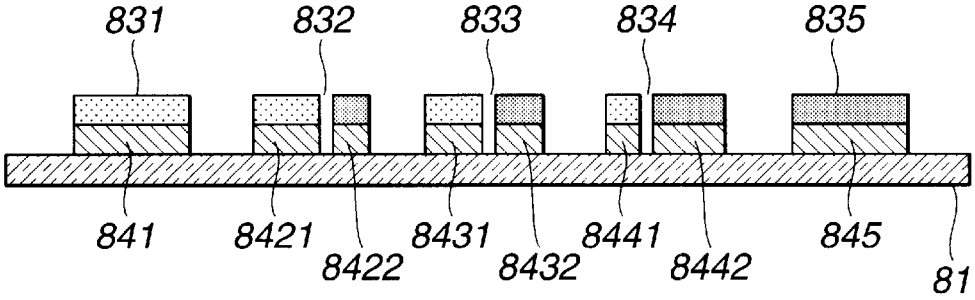
Figure 9D:
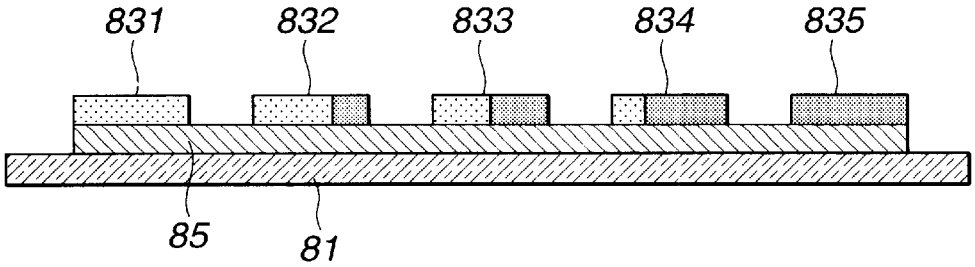
Figure 10A:
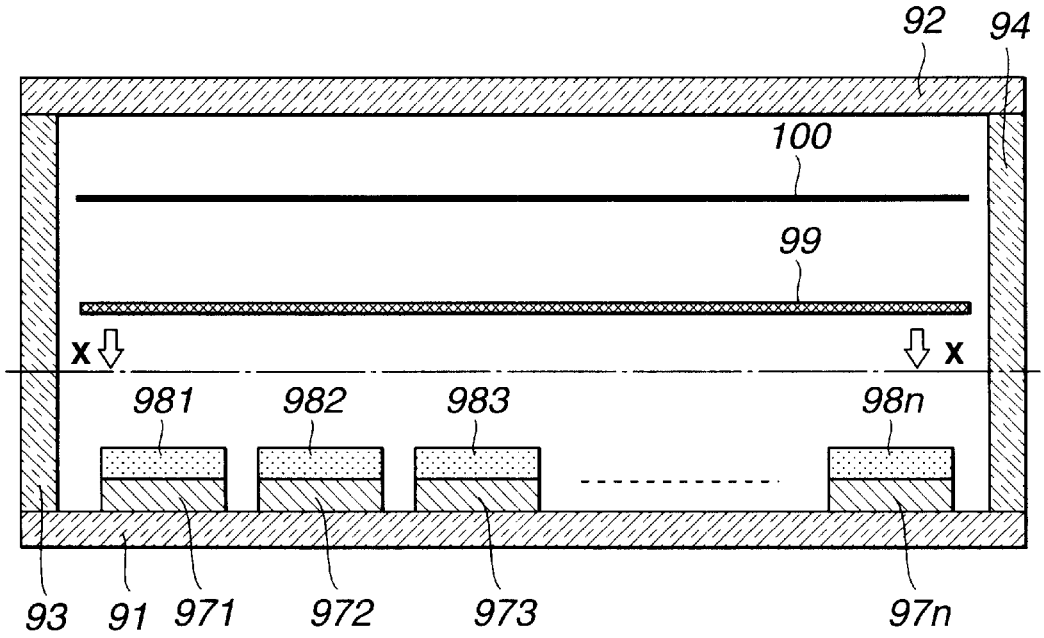
FIG. 10(*a*) is a sectional view showing a gradation fluorescent display device of the conventional gradation display type.
Figure 10B:
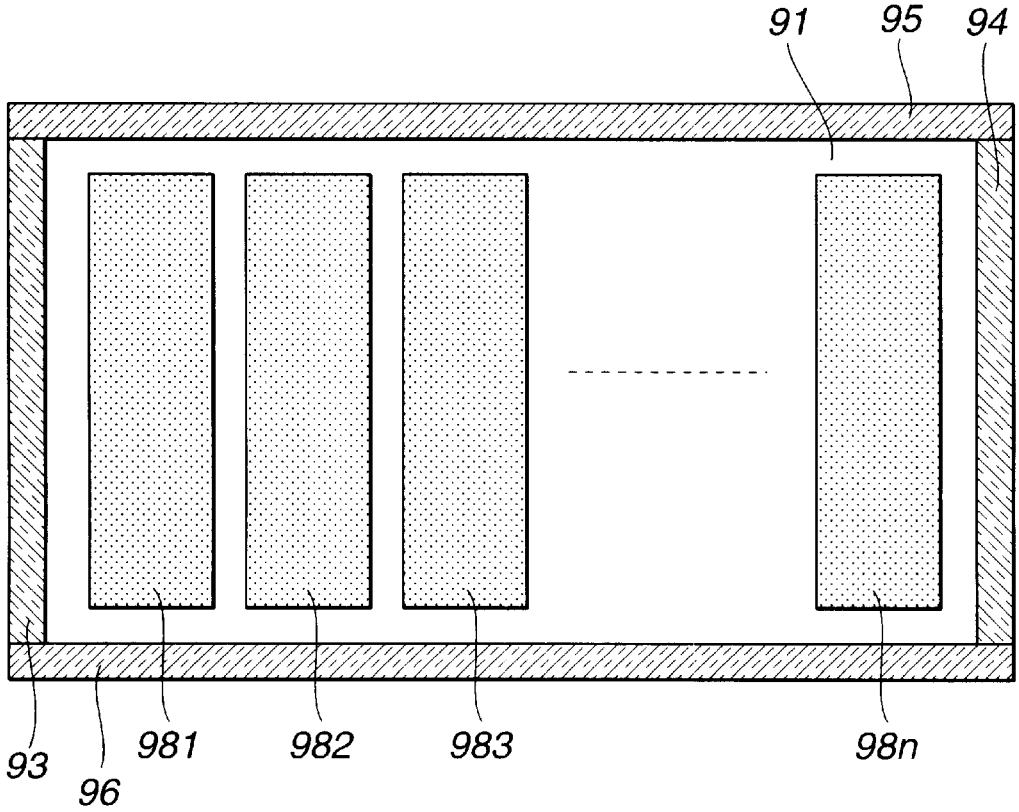

The fluorescent display device shown in FIG. 6(*a*) is constructed so as to carry out gradation display in patterns of the FIG. 8 each constituted by seven display segments. Reference numerals 631 to 634 designate four display segment groups for first to fourth digits, respectively. A phosphor film of each of the display segments is constituted by two selected from three phosphor film elements of luminous hues R, Y and B. The display segments of the display segment group for each digit have a luminous hue varied from left to right within each display segment group in FIG. 6(*a*). Also, the display segment groups are varied in luminous hue in order of digit from left to right. Such a variation in luminous hue is obtained by varying an area ratio between the phosphor film elements of the luminous hues R, Y and B as in the above-described embodiments.

FIG. 6(*b*) shows a modification of the fluorescent display device shown in FIG. 6(*a*). The modification is so configured that 49 (=7×7) display segments are arranged in a matrix-like manner, resulting in carrying out gradation display in a matrix-like pattern. The display segments have a luminous hue stepwise varied or shifted from a luminous hue Y to a luminous hue B in at least one of a direction of an arrow A, a direction of an arrow B and a diagonal direction. Such a variation in luminous hue is carried out by varying an area ratio between phosphor film elements of luminous hues Y and B.

Figure 7A:
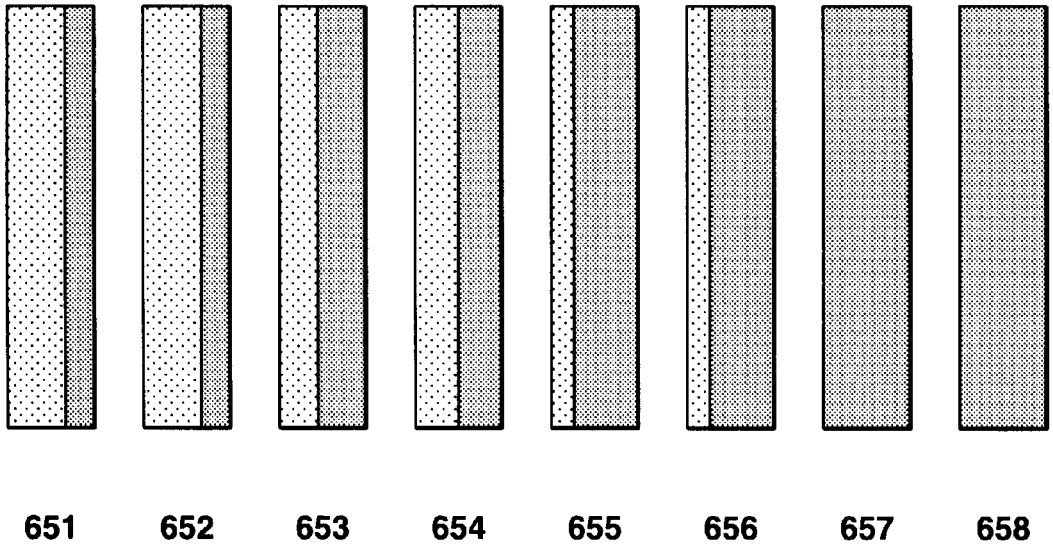
FIGS. 7(*a*) and 7(*b*) each are a plan view showing a display segment pattern in a seventh embodiment of a gradation fluorescent display device according to the present invention, wherein the display segment pattern is configured so as to carry out gradation display in every display segment group.
Figure 7B:
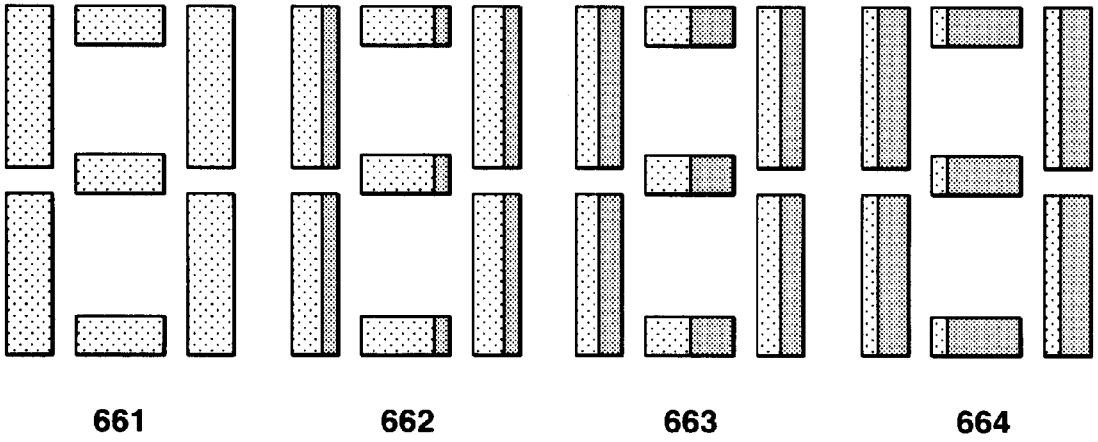

Referring now to FIG. 7(*a*), a seventh embodiment of a fluorescent display device according to the present invention is illustrated, which is constructed so as to carry out gradation display for every display segment group. More particularly, each two bar-like display segments constitute each display segment group. A luminous hue of display segments is varied in order for every display segment group, to thereby carry out gradation display.

Phosphor films 651 to 658 of the display segments are so constructed that a luminous hue of the phosphor films is varied or shifted in order in units of phosphor film groups consisting of the phosphor films 651 and 652, 653 and 654, 655 and 656, and 657 and 658.

FIG. 7(*b*) shows a modification of the fluorescent display device shown in FIG. 6(*a*), which is configured so as to carry out gradation display in patterns of the FIG. 8 each constituted by seven display segments. Reference numerals 661 to 664 designate four display segment groups for first to fourth digits, respectively. Seven such display sections of each display segment group are constructed so as to exhibit the same luminous hue and the display segment groups exhibit a luminous hue different for every digit.

Referring now to FIG. 8(*a*), a pattern of arrangement of phosphor film elements different in luminous hue or the like which constitute phosphor films of display segments in an eighth embodiment of a fluorescent display device according to the present invention is illustrated.

In the illustrated embodiment, phosphor films 671 and 675 each are constituted by only one type of phosphor film element. Phosphor films 672, 673 and 674 each have a surface divided into three parts, on which two kinds of phosphor film elements are deposited in juxtaposition to each other.

FIG. 8(*b*) shows a modification of FIG. 8(*a*). Phosphor films 681 and 685 of display segments each are constituted by only one kind of phosphor film element. Phosphor films 682, 683 and 684 each have a surface divided into 12 parts in a lattice-like manner, on which two kinds of phosphor film elements are deposited in juxtaposition to each other.

An increase in number of divisions of the phosphor film in the illustrated embodiment permits a luminous hue of the phosphor film of each of the display segments to be uniform on a whole surface thereof irrespective of the fact that the luminous hue is a combination of luminous hues of the phosphor film elements constituting the phosphor film.

Referring now to FIGS. 9(*a*) to 9(*d*), a structure of anode electrodes incorporated in a ninth embodiment of a fluorescent display device according to the present invention is illustrated, wherein FIG. 9(*a*) is a plan view showing a glass substrate and FIGS. 9(*b*) to 9(*d*) each are a sectional view of line W—W of FIG. 9(*a*). In each of FIGS. 9(*b*) to 9(*d*), five display segments are arranged, each of which is constituted by an anode electrode and a phosphor film. Five such display segments are arranged in a pattern shown in FIG. 9(*a*). Reference numeral 81 designates a glass substrate and 831 to 835 each are a phosphor film formed on each of anode electrodes 821 to 825.

In FIG. 9(*b*), anode electrodes 821 to 825 of the display segments are formed into the same configuration and have the phosphor films 831 to 835 formed thereon, respectively.

In FIG. 9(*c*), anode electrodes of the display segments are divided in correspondence to the phosphor films 831 to 835 formed thereon, respectively. The phosphor films 831 and 835 are constituted by one kind of phosphor film element of a luminous hue Y and that of a luminous hue B, respectively, so that the anode electrodes 841 and 845 respectively having the phosphor films 831 and 835 formed thereon are not divided. The phosphor films 832, 833 and 834 each are constituted by two kinds of phosphor film elements or the phosphor film elements of the luminous hues Y and B. The anode electrodes having the phosphor films 832 to 834 deposited thereon are divided into two parts 8421 and 8422, 8431 and 8432, and 8441 and 8442, respectively. Even when a gap is defined between the two parts of each of the anode electrodes, colors emitted from the respective two parts are recognized to be a mixed color so long as the gap is sufficiently narrow.

In FIG. 9(*d*), a single anode electrode 85 is formed in a solid manner so as to be common to the five display segments. The single anode electrode 85 has the phosphor films 831 to 835 of the display segments formed thereon.

In each of the embodiments described above, the phosphor film formed on each of the display segments may be constituted by two kinds of phosphor film elements. Alternatively, it may be constituted by three kinds of phosphor film elements. In this instance, three kinds of phosphor film elements respectively having red, green and blue luminous hues may be used for the phosphor film and a ratio in area among the phosphor film elements may be adjusted. This results in gradation display being attained with respect to all hues.

As can be seen from the foregoing, the fluorescent display device of the present invention may be so constructed that the phosphor film on each of the display segments is constituted by a plurality of phosphor film elements different in luminous hue arranged in juxtaposition to each other. Such construction permits a luminous hue of each display segment to be a mixture of luminous hues of the phosphor film elements of the display segment. Thus, the present invention may provide many kinds of luminous hues by merely varying an area ratio among the phosphor film elements. Also, the present invention may provide various kinds of luminous chroma or luminous lightness by juxtaposing phosphor films different in luminous chroma or luminous lightness to each other.

Thus, the present invention carries out display of which luminous hue, luminous chroma or luminous lightness is gradated, by stepwise varying an area ratio among the juxtaposed phosphor film elements for the display segments.

This results in the present invention eliminating a necessity of preparation of phosphors at mixing ratios corresponding to the number of display segments which is required in manufacturing of the conventional gradation display type fluorescent display device. Thus, the present invention reduces the number of types of phosphors required for formation of the phosphor films. This permits a reduction in the number of times of application of the phosphor film, to thereby facilitate the application. Also, it facilitates both adjustment of a mixing ratio of phosphors and formulation thereof.

Such a reduction in the number of times of application of the phosphor films minimizes or substantially prevents disadvantages such as damage to a phosphor film previously applied, pollution of the phosphor film and the like during the application step. Thus, the present invention significantly enhances quality of gradation display of the fluorescent display device and increases yields in manufacturing of the fluorescent display device.

Moreover, the present invention exhibits a satisfactory gradation effect by stepwise varying luminous areas of the display segments. This effectively eliminates a necessity of developing a phosphor having a novel hue or the like in conformity to user's demand on gradation display.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fluorescent display device comprising:

a plurality of display segments each including an anode electrode and a phosphor film deposited on said anode electrode;

said phosphor film being constituted by phosphor film elements different in luminous hue which are arranged in juxtaposition to each other;

said phosphor film elements different in luminous hue of each of said phosphor films having an area ratio therebetween varied depending on the display segment.

2. A fluorescent display device comprising:

a plurality of display segments each including an anode electrode and a phosphor film deposited on said anode electrode;

said phosphor film being constituted by phosphor film elements different in luminous chroma or luminous lightness which are arranged in juxtaposition to each other;

said phosphor film elements different in luminous chroma or luminous lightness of each of said phosphor films having an area ratio therebetween varied depending on the display segment.

3. A fluorescent display device comprising:

a plurality of display segments each including an anode electrode and a phosphor film deposited on said anode electrode;

said phosphor film of each of said display segments having an area varied in order depending on the display segment.

4. A fluorescent display device as defined in claim 1 or 2, wherein said phosphor film of a part of said display segments is constituted by one kind of phosphor film element.

5. A fluorescent display device as defined in claim 1 or 2, wherein said display segments constitute a display segment group;

said area ratio between said phosphor film elements being varied depending on said display segment group.

6. A fluorescent display device as defined in claim 1 or 2, wherein an area of each of said display segments is varied depending on the display segment.

* * * * *